US005578410A

United States Patent [19]

Petropoulos et al.

[11] Patent Number: 5,578,410

[45] Date of Patent: Nov. 26, 1996

[54] DIP COATING METHOD

[75] Inventors: Mark C. Petropoulos, Ontario; Geoffrey M. T. Foley, Fairport; Eugene A. Swain, Webster, all of N.Y.

[73] Assignee: Xerox Corporation, Stamford, Conn.

[21] Appl. No.: 467,129

[22] Filed: Jun. 6, 1995

[51] Int. Cl.[6] ..... G03G 5/02

[52] U.S. Cl. ..... 430/133; 430/134; 427/430.1

[58] Field of Search ..... 430/133, 134, 430/127; 427/75, 105, 430.1

[56] References Cited

U.S. PATENT DOCUMENTS

| | | | |
|---|---|---|---|
| 4,341,817 | 7/1982 | Tozier et al. | 427/430.1 |
| 4,353,934 | 10/1982 | Nakashima et al. | 427/57 |
| 4,610,942 | 9/1986 | Yashiki et al. | 430/58 |
| 4,618,559 | 10/1986 | Yashiki | 430/127 |
| 5,043,187 | 8/1991 | Takahashi | 427/430.1 |
| 5,120,627 | 6/1992 | Nozomi et al. | 430/59 |
| 5,244,697 | 9/1993 | Vackier et al. | 427/430.1 |
| 5,279,916 | 1/1994 | Sumino et al. | 430/134 |
| 5,418,349 | 5/1995 | Swain et al. | 430/127 |
| 5,422,144 | 6/1995 | Speakman, Jr. | 427/430.1 |

*Primary Examiner*—Christopher D. Rodee
*Attorney, Agent, or Firm*—Zosan S. Soong

[57] ABSTRACT

There is disclosed a dip coating method for fabricating a photosensitive member employing a substrate which defines a top non-imaging portion, a middle imaging portion, and a bottom non-imaging portion, wherein the method comprises: (a) immersing the bottom non-imaging portion, the middle imaging portion, and optionally a part of the top non-imaging portion of the substrate in a coating solution; (b) raising the middle imaging portion out of the coating solution; and (c) raising the bottom non-imaging portion out of the coating solution at a take-up speed which is decreasing from the take-up speed of the substrate at the junction between the middle imaging portion and the bottom non-imaging portion, thereby reducing the size of any bead on the bottom non-imaging portion.

10 Claims, 1 Drawing Sheet

DIP COATING METHOD

This invention relates generally to a dip coating method useful for example in the fabrication of a photosensitive member and more particularly to a dip coating method which employs a variable take-up speed profile to minimize the size of any bead on the bottom edge of a substrate. The term bead refers to a coating buildup such as an excessively thick portion of the coating on the substrate.

Dip coating is a coating method involving dipping a substrate in a coating solution and taking up the substrate. In dip coating, the coating thickness depends on the concentration of the coating material and the take-up speed, i.e., the speed of the substrate being lifted from the surface of the coating solution. It is known that the coating thickness generally increases with the coating material concentration and with the take-up speed. A problem which typically occurs during dip coating is that a bead is formed on the bottom end portion of the substrate, especially at the bottom edge. The bead can be quite large such as from about 200 to 300 microns in thickness (measured from the substrate surface) and from about 5 to 10 mm in width (measured along the length of the substrate). A large bead is undesirable since it can interfere with the cleaning blade operation in an electrostatographic printing apparatus. Conventionally, the bead may be removed by wiping with a solvent or by cutting off the bottom edge containing the bead, thereby increasing fabrication costs. Thus, there is a need, which the present invention addresses, for a dip coating method that reduces the size of the bead.

The following documents disclose conventional dip coating methods, dip coating apparatus, and photosensitive members:

Yashiki et al., U.S. Pat. No. 4,610,942, discloses an electrophotographic member having corresponding thin end portions of charge generation and charge transport layers;

Nozomi et al., U.S. Pat. No. 5,120,627, discloses an electrophotographic photoreceptor having a dip coated charge transport layer; and Sumino et al., U.S. Pat. No. 5,279,916, discloses a process for producing an electrophotographic photosensitive member.

SUMMARY OF THE INVENTION

The present invention is accomplished in embodiments by providing a dip coating method for fabricating a photosensitive member employing a substrate which defines a top non-imaging portion, a middle imaging portion, and a bottom non-imaging portion, wherein the method comprises:

(a) immersing the bottom non-imaging portion, the middle imaging portion, and optionally a part of the top non-imaging portion of the substrate in a coating solution;

(b) raising the middle imaging portion out of the coating solution; and (c) raising the bottom non-imaging portion out of the coating solution at a take-up speed which is decreasing from the take-up speed of the substrate at the junction between the middle imaging portion and the bottom non-imaging portion, thereby reducing the size of any bead on the bottom non-imaging portion.

BRIEF DESCRIPTION OF THE DRAWINGS

Other aspects of the present invention will become apparent as the following description proceeds and upon reference to the Figures which represent preferred embodiments.

DETAILED DESCRIPTION

Figure 1:
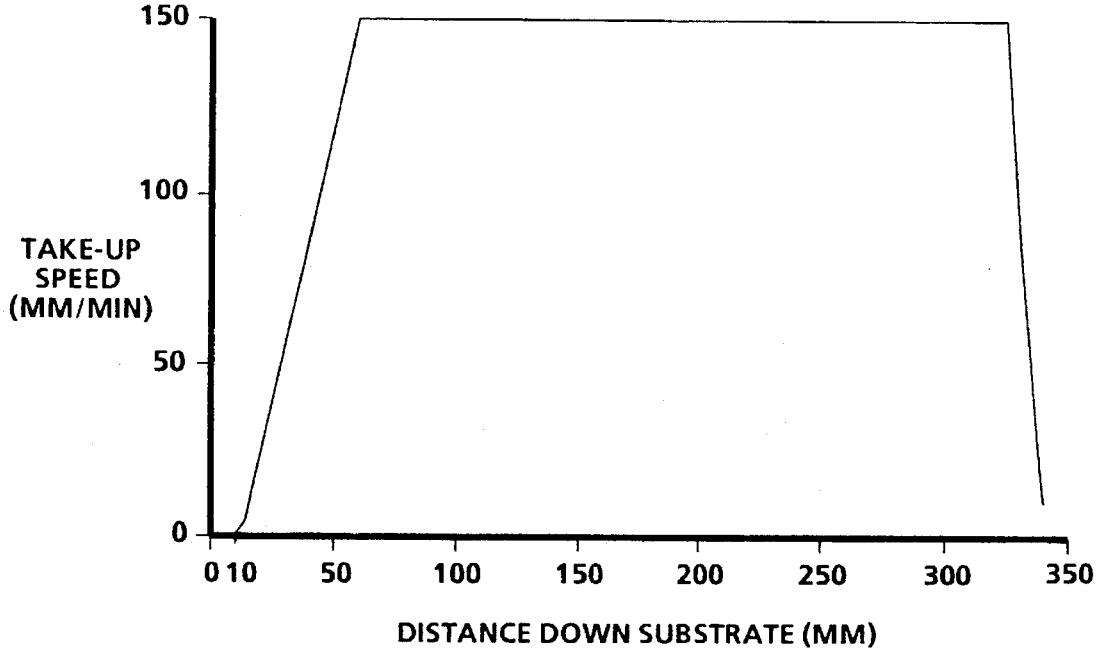
FIG. 1 is a graph depicting a take-up speed profile for the coating of a substrate.

The substrate preferably is a hollow cylinder and defines a top non-imaging portion, a middle imaging portion, and a bottom non-imaging portion. The precise dimensions of these three substrate portions vary in embodiments. As illustrative dimensions, the top non-imaging portion ranges in length from about 10 to about 50 mm, and preferably from about 20 to about 40 mm. The middle imaging portion may range in length from about 200 to about 400 mm, and preferably from about 250 to about 300 mm. The bottom non-imaging portion may range in length from about 10 to about 50 mm, and preferably from about 20 to about 40 mm. The substrate may be bare of layered material or may be coated with a layered material such as those described herein prior to immersion of the substrate into the coating solution.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 10 centimeters, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a cylindrical drum, an endless flexible belt, and the like.

A chucking apparatus engages the top end of the substrate and lowers the bottom non-imaging portion, the middle imaging portion, and optionally a part of the top non-imaging portion into the coating solution. There may be an optional pause, which may last for example from about 1 to about 60 seconds, where the substrate is motionless after lowering of the substrate into the coating solution to permit any disturbance in the coating solution to dissipate.

The coating solution may comprise any suitable liquid including solutions typically employed to coat layered material on the substrate during fabrication of photosensitive or photoconductive members. For example, the coating solution may comprise components for the charge transport layer and/or the charge generating layer, such components and amounts thereof being illustrated for instance in U.S. Pat. No. 4,265,990, U.S. Patent No. 4,390,611, U.S. Pat. No. 4,551,404, U.S. Pat. No. 4,588,667, U.S. Pat. No. No. 4,596,754, and U.S. Pat. No. 4,797,337, the disclosures of which are totally incorporated by reference. In embodiments, the coating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the coating solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like.

The coating solution may also comprise materials typically employed as a subbing layer, barrier layer, adhesive layer, and the like. Accordingly, the coating solution may comprise, for example, casein, polyvinyl alcohol, nitrocellulose, ethyleneacrylic acid copolymer, polyamide (nylon 6, nylon 66, nylon 610, copolymerized nylon, alkoxymethylated nylon, and the like), polyurethane, gelatin, polyester, polyvinylbutyral, polyvinylpyrrolidone, polycarbonate, polyurethane, polymethyl methacrylate, and the like as well as mixtures thereof.

A part of the middle imaging portion, preferably the entire length thereof, is raised from the coating solution at a generally constant take-up speed which may be for example from about 50 to about 500 mm/min, preferably from about 100 to about 200 mm/min. The phrase generally constant speed encompasses deviations from the constant speed up to about 10% in magnitude. A generally constant speed (referred herein as "constant speed ") is preferred for the entire length of the middle imaging portion since the constant speed produces a coating having a substantially uniform thickness which is desirable in certain embodiments for a photosensitive member. In embodiments, the generally constant take-up speed is typically maintained until the junction between the middle imaging portion and the bottom non-imaging portion. To ramp up to the constant speed, the part of the top non-imaging portion immersed in the coating solution is raised out of the coating solution at a take-up speed which starts from 0 and increases to the constant speed.

The bottom non-imaging portion is raised out of the coating solution at a take-up speed which is decreasing from the take-up speed of the substrate at the junction between the middle imaging portion and the bottom non-imaging portion. In one approach, the take-up speed is not reduced to 0 prior to or during movement of the bottom non-imaging portion out of the coating solution. The take-up speed for raising the bottom non-imaging portion is decreased, preferably at a constant rate, to a final speed (referred herein as "final speed") from the take-up speed of the substrate at the junction (referred herein as "junction speed") between the middle imaging portion and the bottom non-imaging portion. The final speed may be for example below 50 mm/min, preferably from about 5 to about 25 mm/min, and especially about 10 mm/min. The take-up speed may be decreased to the final speed at a rate for example from about 5 to about 40 mm/min per mm, preferably from about 10 to about 30 mm/min per mm, and more preferably from about 20 to about 25 mm/min per mm.

Raising the bottom non-imaging portion out of the coating solution at a take-up speed which is decreasing from the junction speed may be accomplished in a second approach by the following: decreasing the take-up speed to 0 subsequent to the raising of the middle portion out of the coating solution, pausing for a period of time to promote drying of the coated middle portion, and then increasing the take-up speed of the bottom non-imaging portion to the final speed which is slower than the junction speed. The take-up speed can be decreased to 0 at a preferably constant rate ranging for example from about 5 to about 40 mm/min per mm, preferably from about 10 to about 30 mm/min per mm, and more preferably from about 20 to about 25 mm/min per mm. By the time the take-up speed reaches 0, a portion of the bottom non-imaging portion ranging for example from about 20% to about 60% is raised out of the coating solution. The pause may last in duration for example from about 5 seconds to about 5 minutes, and preferably from about 10 seconds to about 2 minutes. To reach the final speed, the take-up speed can be increased at a preferably constant rate ranging for example from about 3 to about 30 mm/min per mm, preferably from about 5 to about 20 mm/min per mm, and more preferably from about 5 to about 10 mm/min per mm. The final speed of the bottom non-imaging portion in this second approach portion may be the same as described herein for the first approach.

The final take-up speed of the bottom imaging portion may be smaller than the junction speed by about 40% to about 90%, and preferably from about 50% to about 80% (percentages based on the junction speed). The present invention allows a reduction in the thickness and the width of the bead by about 40% to 100%, and preferably from about 50% to about 90% (based on a bead produced by raising both the middle imaging portion and the bottom non-imaging portion at the same constant take-up speed).

When the substrate is coated with the desired layer or layers, the coated substrate is subjected to elevated temperatures such as from about 100 to about 160 degrees Centigrade for about 0.2 to about 2 hours.

Any suitable apparatus may be employed to hold and move the substrate including the apparatus disclosed in Pietrzykowski, Jr. et al., U.S. Patent No. 5,334,246, the disclosure of which is totally incorporated herein by reference. A preferred equipment to control the speed of the substrate is available from Allen-Bradley Corporation and involves a programmable logic controller with an intelligent motion controller.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

About 20 liters of a charge transport layer coating solution was prepared having the following composition: 10% by weight N,N'-diphenyl- N,N'-bis(3-methylphenyl)-[1,1'-biphenyl]-4,4'diamine; 14% by weight poly(4,4'diphenyl-1,1'-cyclohexane carbonate (400 molecular weight); 57% by weight tetrahydrofuran; and 19% by weight monochlorobenzene. A hollow aluminum cylinder was selected with the following dimensions: a length of about 306 mm, an outside diameter of about 30 mm, and a wall thickness of about 1 mm. A chuck engaged the top end of the cylinder and immersed the bottom portion, the middle portion, and a portion of the top portion (10 mm in length) into the coating solution at an immersion rate of about 600 mm/min. There was a pause of about 5 seconds where the cylinder was motionless after it was dipped into the coating solution. This pause permitted any disturbance in the coating solution to dissipate. The cylinder was raised out of the coating solution according to the take-up speed profile described in FIG. 1, where the substrate area which moved at a constant speed of 150 mm/min corresponded to the middle imaging portion, the substrate area (starting from 10 mm) which moved at the generally increasing speed (from 0 mm/min up to 150 mm/min) corresponded to the top non-imaging portion, and the substrate area which moved at the decreasing speed (from 150 mm/min down to 10 mm/min) corresponded to the bottom non-imaging portion. As seen in FIG. 1, the take-up speed increased from 0 to a constant speed of 150 mm/min which raised the immersed part of the top non-imaging portion and the entire middle imaging portion out of the coating solution. Starting at the junction between the middle imaging portion and the bottom non-imaging portion, the take-up speed was reduced to a final speed of 10 mm/min at a rate of about 25 mm/min per mm. The take-up speed profile of FIG. 1 took about 10 minutes to complete. The coating on the middle portion was about 28 microns thick. The coating on the bottom non-imaging portion ranged in thickness from about 5 to about 20 microns. No bead was visually observed at the bottom edge of the bottom non-imaging portion.

EXAMPLE 2

Figure 2:
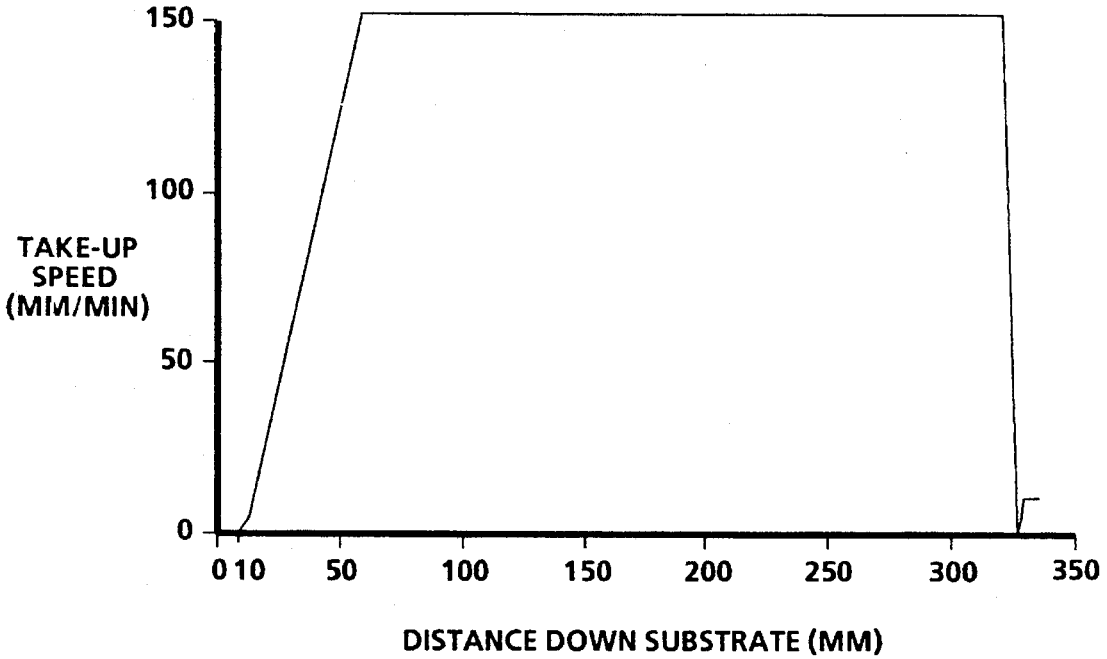
FIG. 2 is a graph depicting a second take-up speed profile for the coating of a substrate.

A second hollow aluminum cylinder, identical to the cylinder in Example 1, was dip coated according to the same procedure described in Example 1 except the cylinder was raised out of the coating solution using the take-up speed profile described in FIG. 2. As seen in FIG. 2, the take-up speed increased from 0 to a constant speed of 150 mm/min which raised the immersed part of the top non-imaging portion and the entire middle imaging portion out of the coating solution. Starting at the junction between the middle imaging portion and the bottom non-imaging portion, the take-up speed was reduced to 0 at a rate of about 25 mm/min per mm. There was a pause lasting about 5 minutes to allow a portion of the solvent in the coating on the middle portion to evaporate. Then the take-up speed was increased from 0 to a final speed of 10 mm/min at a rate of about 5 mm/min per mm. The take-up speed profile of FIG. 2 took about 10 minutes to complete. The coating on the middle portion was about 28 microns thick. The coating on the bottom non-imaging portion ranged in thickness from about 5 to about 20 microns. No bead was visually observed at the bottom edge of the bottom non-imaging portion.

Comparative Example

A third hollow aluminum cylinder, identical to the cylinder in Example 1, was dip coated according to the same procedure described in Example 1 and FIG. 1 except both the middle imaging portion and the bottom non-imaging portion were raised out of the coating solution at the same constant speed of about 150 mm/min. The removal of the cylinder from the coating solution took about 10 minutes to complete. The coating on the middle portion was about 28 microns thick. There was a large bead at the bottom edge of the bottom non-imaging portion which had a thickness of about 200 microns (measured from the substrate surface) and a width of about 5 mm. The coating on the rest of the bottom non-imaging portion had a thickness of about 28 microns.

As seen in the Examples, the present invention significantly reduces the size of the bead in terms of both thickness and width, which eliminates or minimizes the need to wipe the bead with a solvent or to remove the bottom edge containing the bead.

Other modifications of the present invention may occur to those skilled in the art based upon a reading of the present disclosure and these modifications are intended to be included within the scope of the present invention.

We claim:

1. A dip coating method for fabricating a photosensitive member employing a substrate which defines a top non-imaging portion, a middle imaging portion, and a bottom non-imaging portion, wherein the method comprises:

(a) immersing the bottom non-imaging portion, the middle imaging portion, and optionally a part of the top non-imaging portion of the substrate in a coating solution, wherein the coating solution comprises a charge transport material, a charge generating material, or both the charge transport material and the charge generating material;

(b) raising the middle imaging portion out of the coating solution to produce a coating having a substantially uniform thickness on the middle imaging portion; and (c) raising the bottom non-imaging portion out of the coating solution at a take-up speed which is continuously decreasing from the take-up speed of the substrate at the junction between the middle imaging portion and the bottom non-imaging portion to a final take-up speed.

2. The method of claim 1, wherein the substrate prior to (a) is coated with a layered material.

3. The method of claim 1, wherein (c) comprises decreasing the take-up speed at a constant rate.

4. The method of claim 1, wherein (c) comprises decreasing the take-up speed to a final speed below about 50 mm/min.

5. The method of claim 1, wherein (c) comprises decreasing the take-up speed to a final speed ranging from about 5 to about 25 mm/min.

6. A dip coating method for fabricating a photosensitive member employing a substrate which defines a top non-imaging portion, a middle imaging-portion, and a bottom non-imaging portion, wherein the method comprises:

(a) immersing the bottom non-imaging portion, the middle imaging portion, and optionally a part of the top non-imaging portion of the substrate in a coating solution, wherein, the coating solution comprises a charge transport material, a charge generating material, or both the charge transport material and the charge generating material (b) raising the middle imaging portion out of the coating solution to produce a coating having a substantially uniform thickness on the middle imaging portion; end (c) decreasing the take-up speed to 0, pausing for a period of time to promote drying of the coated middle portion, end increasing the take-up speed to a final speed slower than the take-up speed of the substrate at the junction between the middle imaging portion and the bottom non-imaging portion.

7. The method of claim 6, wherein (c) comprises pausing for a period of time ranging from about 5 seconds to about 5 minutes.

8. The method of claim 6, wherein (c) comprises increasing the take-up speed to the final speed below about 50 mm/min.

9. The method of claim 6, wherein (c) comprises decreasing the take-up speed to 0 at a constant rate.

10. The method of claim 6, wherein (c) comprises increasing the take-up speed to the final speed at a constant rate.

* * * * *